US010850889B2

(12) United States Patent
Ramon et al.

(10) Patent No.: US 10,850,889 B2
(45) Date of Patent: Dec. 1, 2020

(54) DEVICE FOR ADAPTING THE SPACING BETWEEN TWO PLATE-SHAPED BEARING ELEMENTS FOR STORING CONTAINERS

(71) Applicant: Cabka GmbH & Co. KG, Weira (DE)

(72) Inventors: Gat Ramon, Berlin (DE); Evert Veldhuis, Berlin (DE); Thorsten Lenz, Berlin (DE)

(73) Assignee: Cabka GmbH & Co. KG, Weira (DE)

( * ) Notice: Subject to any disclaimer, the term of this patent is extended or adjusted under 35 U.S.C. 154(b) by 0 days.

(21) Appl. No.: 16/787,127

(22) Filed: Feb. 11, 2020

(65) Prior Publication Data

US 2020/0180813 A1 Jun. 11, 2020

Related U.S. Application Data

(63) Continuation of application No. 16/308,395, filed as application No. PCT/EP2017/062235 on May 22, 2017, now Pat. No. 10,604,298.

(30) Foreign Application Priority Data

Jun. 8, 2016 (EP) ..... 16173535

(51) Int. Cl.
*B65D 19/38* (2006.01)

(52) U.S. Cl.
CPC .. *B65D 19/385* (2013.01); *B65D 2519/00024* (2013.01); *B65D 2519/00029* (2013.01); *B65D 2519/00034* (2013.01); *B65D 2519/00039* (2013.01); *B65D 2519/00059* (2013.01); *B65D 2519/00064* (2013.01);

(Continued)

(58) Field of Classification Search
CPC ..... A47B 9/04; A47B 9/10; B65D 19/385
See application file for complete search history.

(56) References Cited

U.S. PATENT DOCUMENTS 3,850,295 A 11/1974 Black
2014/0020488 A1 1/2014 Koch et al.

(Continued)

FOREIGN PATENT DOCUMENTS

CH 626592 11/1981
DE 202008010072 11/2008

(Continued)

OTHER PUBLICATIONS

International Preliminary Report on Patentability dated Dec. 11, 2018 From the International Bureau of WIPO Re. Application No. PCT/EP2017/062235. (7 Pages).

(Continued)

*Primary Examiner* — Matthew W Ing

(57) ABSTRACT

A device for adapting the spacing between two board-type bearing elements for the vertical storage of barrels, comprising a number of supporting rods for insertion between the two bearing elements as well as structure for individually and infinitely variably adjusting the length of the supporting rods depending on the height of the barrels for locally varying the spacing between the two bearing elements. The structure for adjusting the length of each supporting rod comprise either two partial rods connected via a screw thread or a height-adjustment element, which is connected to one end of the supporting rod via a screw thread. Alternatively, the supporting rod can also be formed as a hydraulically or pneumatically length-adjustable telescopic rod.

12 Claims, 7 Drawing Sheets

Figure 1:
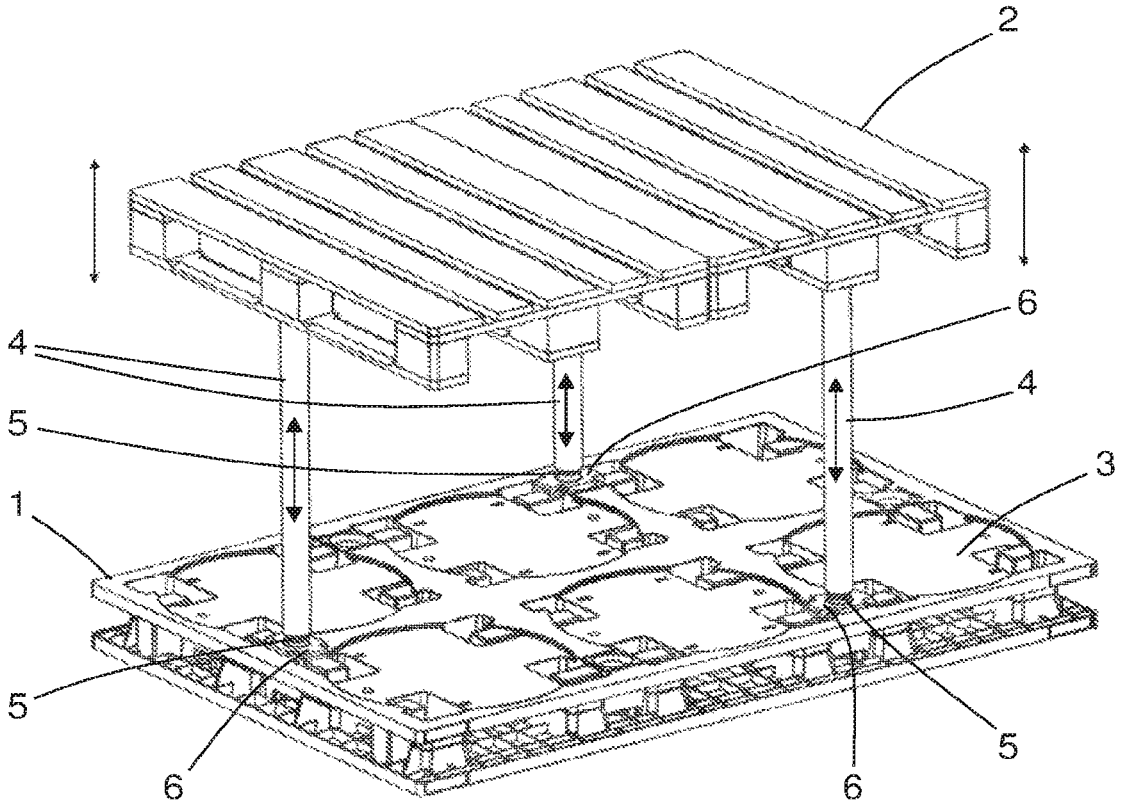

(52) U.S. Cl.
CPC ..... *B65D 2519/00069* (2013.01); *B65D 2519/00074* (2013.01); *B65D 2519/0097* (2013.01); *B65D 2519/00288* (2013.01); *B65D 2519/00293* (2013.01); *B65D 2519/00318* (2013.01); *B65D 2519/00323* (2013.01); *B65D 2519/00641* (2013.01); *B65D 2519/00696* (2013.01); *B65D 2519/00815* (2013.01)

(56) References Cited

U.S. PATENT DOCUMENTS

| | | | |
|---|---|---|---|
| 2014/0054522 | A1 | 2/2014 | Panzer et al. |
| 2016/0060882 | A1 | 3/2016 | Bond |
| 2018/0020831 | A1 | 1/2018 | Lenz |
| 2019/0135487 | A1 | 5/2019 | Ramon et al. |

FOREIGN PATENT DOCUMENTS

| | | |
|---|---|---|
| EP | 1975340 | 10/2008 |
| EP | 2390198 | 11/2011 |
| EP | 2687454 | 1/2014 |
| EP | 2700608 | 2/2014 |
| FR | 2995301 | 3/2014 |
| GB | 2526883 | 12/2015 |
| WO | WO 00/69756 | 11/2000 |
| WO | WO 2008/025100 | 3/2008 |
| WO | WO 2015/070312 | 5/2015 |
| WO | WO 2017/211576 | 12/2017 |

OTHER PUBLICATIONS

Internationaler Recherchenbericht und Schriftlicher Bescheid [International Searching Report and the Written Opinion] dated Sep. 22, 2017 From the International Searching Authority Re. Application No. PCT/EP2017/062235 and Its Translation Into English. (20 Pages).

Official Action dated Mar. 28, 2019 From the US Patent and Trademark Office Re. U.S. Appl. No. 16/308,395. (11 Pages).

DEVICE FOR ADAPTING THE SPACING BETWEEN TWO PLATE-SHAPED BEARING ELEMENTS FOR STORING CONTAINERS

RELATED APPLICATIONS

This application is a continuation of U.S. patent application Ser. No. 16/308,395 filed on Dec. 7, 2018, which is a National Phase of PCT Patent Application No. PCT/EP2017/062235 having International Filing Date of May 22, 2017, which claims the benefit of priority of German Patent Application No. 16173535.2 filed on Jun. 8, 2016.

The contents of the above applications are all incorporated by reference as if fully set forth herein in their entirety.

FIELD OF THE INVENTION

The invention relates to a device for adapting the spacing between a first board-type bearing element and a second board-type bearing element arranged above that, wherein both bearing elements are used to store containers, such as, for example, barrels.

BACKGROUND OF THE INVENTION

In the state of the art, various methods are used for the storage of larger containers, for example, of barrels. A first method consists of arranging the containers vertically or horizontally in a rack structure, the bearing elements in this case are shelves or rack boards which are arranged at fixedly predefined spacings from each other. The spacings are, as a rule, predefined on the bearing elements, for example, on column-type supports at the corners of the rack boards or on side walls, in other cases there is no provision at all for spacing variation, in order not to impair the stability of the rack or storage facility.

In other cases, for example, when storing vertical barrels, a first layer of barrels is stored on a first bearing element, then the second bearing element with a second layer of barrels is deposited or arranged on these barrels. This method is applied in particular in the case of long-term storage, for example, in the case of distillates ageing in wooden barrels.

Neither storage method is free of disadvantages. Storing the containers in racks with fixedly pre-set spacings between the rack bases or bearing elements allows no, or only a very laborious, adaptation to different container sizes. This often has the result that in the case of smaller containers space in the storage facility is wasted, as it cannot be optimally utilized if, for example, the spacing between the bearing elements is substantially larger than the height of the containers, or if the containers are too tall, with the result that they cannot be accommodated at all.

In the case of a stacking of the bearing elements directly on the containers, on the other hand, the containers at the bottom are heavily loaded by the weight of the containers on top. The number of layers which can be stacked one on top of another is therefore limited—often only two or three layers can be stacked one on top of another—and significantly depends on the stability of the structure of the containers. If, for example, the containers are wooden barrels, such as are used for storing whisky, then the loading from above also has the result that the staves, usually held together by barrel hoops, of the barrels below bulge outwards more than envisaged, with the result that gaps which are large enough for liquid or gas to leak out form between the individual staves. As the tolerances in the manufacture of wooden barrels are greater and these are often manufactured individually, the wooden barrels often also have slightly different heights, which has the result, in the case of vertical storage, that taller barrels are loaded more heavily that shorter barrels. The quantity of liquid leaking is several percent annually, thus is financially significant. In this case, as a rule, wooden pallets are used as bearing elements.

All possible sealable hollow bodies which, on the one hand, can be stored vertically or horizontally and, on the other hand, are suitable for holding liquid, solid or powdered materials come into consideration as containers. The containers here are created such that they can be stored vertically or horizontally, for example, they can be designed cuboid. However, the containers are often designed as barrels. By a barrel is meant here, as a rule, a cylindric or cylindrical container produced from wood, metal or plastic, which can also be formed bulged, such as, for example, conventional wine barrels. Barrels without a bulge are also called drums. Such a barrel usually serves to store liquids and as a rule is filled via a bunghole, but it can also serve to store solid or powdered substances and is then, as a rule, provided with a lid.

Finally, there are also rack systems in the state of the art which are clamped between the floor and ceiling of a room. In the case of such rack systems, the supporting columns are, as a rule, designed as telescopic columns or telescopic rods, which allow a bracing against the ceiling or the floor and an adaptation, as a rule infinitely variable, to different heights. However, the spacings between the shelves are also predefined here and can be adjusted only to a limited extent. As a rule, such systems are not suitable for storing larger containers such as barrels, as the supporting structures are not designed for this.

In the case of the systems known in the state of the art, therefore, either the containers are not subjected to any loading, wherein in this case the storage space is not optimally utilized, or else they are loaded, which results in the disadvantages already named above with respect to the stackability and the stability of the containers.

SUMMARY OF THE INVENTION

An object of the invention is therefore to develop a device which enables the best possible utilization of the available space and at the same time keeps the loading of the containers stored on bearing elements as small as possible. This object is achieved in the case of the device described at the beginning for adapting the spacing between two board-type bearing elements in that this device comprises a number of supporting rods for insertion between the first bearing element and the second bearing element as well as means for individually adjusting the length of the supporting rods depending on the height of the containers, for locally varying the spacing between the first and second bearing elements.

In contrast to the state of the art, here the board-type bearing elements are not secured to the supporting rods, rather the supporting rods are introduced between the bearing elements. In a top view of the bearing elements, the supporting rods are thus located completely or predominantly, i.e., more than 50%, with respect to their cross section, between the board-type bearing elements. The bearing elements can be simple, board-type bodies with two large surfaces parallel to each other and four narrow sides, but the bearing elements can also be elements with a more complex construction such as Euro pallets made of wood, or also pallets or bearing elements made of other materials, such as for example metal or plastic. If the supporting rods are dimensioned accordingly, bearing elements made of concrete or stone can also be used. Of course, it is also possible to use bearing elements made of combinations of the materials listed above.

The device is characterized in that it has means for individually adjusting the length of the supporting rods for locally varying the spacing between the first and second bearing elements. The length of the supporting rods can be adjusted individually, i.e., the length of one supporting rod can be adjusted independently of the lengths of the other supporting rods. In this way, a local variation of the spacing is possible, wherein boundary conditions are, of course, to be observed so that the large surfaces of the bearing elements, in particular the surfaces on which the containers are stored, are not tilted relative to the horizontal at an angle so great that the containers are in danger of sliding off the bearing element, thus endangering the stable storage thereof. The spacing between two bearing elements can be altered slightly, for example, only in the area in which an alteration of the spacing is recommended to avoid too heavy a loading of a container arranged in the vicinity of the supporting rod in question.

The adjustment of the length of the supporting rods is dependent on the height of the containers, i.e., the dimension which the containers have along the spacing between the first and second bearing elements. Different container heights can be compensated for in this manner. This is advantageous in particular when a plurality of similar containers, which should in principle have the same height but in fact have slightly different heights because of manufacturing tolerances or as a result of ageing, as is often the case for example, with wooden barrels stored vertically, are stored on the first bearing element. Here, the lengths of the supporting rods can be adapted individually to the height of the tallest barrel, either together, with the result that the second bearing element lies with the first bearing element in planes parallel to a horizontal plane, or individually, which could result in a minimal, but still acceptable, discrepancy. This is advantageous in particular in the case of irregularly shaped storage rooms such as cellars. Then—if the storage room is intended for storing further bearing elements directly on the containers of the bearing element lying underneath—the space made available in the storage room can be optimally utilized on the one hand and on the other hand it can be ensured that the loading by the containers on the lower bearing elements is either reduced or completely eliminated, if the supporting rods are dimensioned such that they can bear the load completely or transmit it downwards. In the case of wooden barrels, for example, in the case of whisky storage, liquid can in this way be prevented from leaking out of gaps between the staves. The financial losses are thus reduced.

In principle, it is possible and sufficient to provide a length alteration in discrete steps. However, this is only practicable when the supporting rods are dimensioned such that they fully absorb the load. In a preferred embodiment of the invention the means for adjusting the length of the supporting rods are therefore designed to adjust them infinitely variably. On the one hand this makes an optimal utilization of space possible and on the other hand it is furthermore possible to divide the load between the containers on the one hand and the supporting rods on the other hand, with the result that the supporting rods can be dimensioned smaller in terms of their thickness, as they do not need to absorb the full load; for their part the containers are relieved of load.

There are several possibilities for realizing the means for individually adjusting the length of each supporting rod, for example, a supporting rod can consist of two partial rods which are connected to each other via a screw thread. One end of one partial rod then has, for example, an internal screw thread and one end of the other partial rod has a matching external screw thread. Both partial rods can have the same length, then the screw thread is located, for example, in the centre. In another embodiment, which can of course be combined with the one just described, the device comprises a height-adjustment element, which is connected to one end of a supporting rod for example via a screw thread. Such a screw thread then allows an infinitely variable adjustment of the height, as a rule an undesired adjustment when the bearing elements and supporting rods are under load is prevented by the static friction in the screw thread. The height-adjustment element can here be designed such that it makes application to different types of bearing element easier. For this purpose, it can likewise be constructed in several parts and be provided with corresponding adapters or fixing means which give the supporting rods a better hold on the bearing elements—even laterally. In the case of the use of a wooden pallet, cramps can be provided on the adapter, for example, for driving into the wood. To improve the connection, it is also possible to provide a screw connection, simple plug-in connections are also possible and then serve in particular to prevent a slipping. The fixing means or adapters can also be formed on the supporting rods themselves, if these do not have a height-adjustment element. A combination is also possible, thus for example a height-adjustment element with fixing means can be provided at one end of the rod, while only fixing means are provided at the other end.

In a preferred embodiment, the supporting rods are formed as hydraulically or pneumatically length-adjustable telescopic rods. This is advantageous in particular when particularly heavy loads are to be supported. With a corresponding drive, these supporting rods are also particularly suitable for automation and make the height adjustment easier.

The number of supporting rods is expediently at least three, which already allows a certain flexibility with respect to adjusting the loading via the height. With four supporting rods, the flexibility with respect to the adjustment of the height depending on the container height becomes even more flexible, the number of supporting rods can also be geared to the number of containers which the bearing elements are designed to store. For example, if six whisky barrels are stored on one bearing element, then the use of four, six or eight supporting rods is expedient.

As a rule, the supporting rods are aligned along the normal of the large surfaces of the board-type bearing elements, but configurations are also conceivable in which the supporting rods are aligned trapezoidally, for example, in the manner of a hexapod, if the loading of the bearing elements is not impaired by this. The height adjustment thus becomes even more flexible, in particular in connection with a hydraulic adjustment.

The supporting rods for their part can also be secured to a frame structure, for example, to a circumferential stainless steel frame to which the supporting rods are secured. The upper, second bearing element then lies for example on the frame structure, and alternatively or supplementarily a frame structure can likewise be provided at the lower ends of the supporting rods, which then lies on the lower, first bearing element. Such frame structures are advantageous in particular in the case of thinner bearing elements, as then the loading which is exerted at isolated points on the bearing elements by the supporting rods is distributed by the frame structure.

In a particularly preferred embodiment, the device comprises motor-driven actuating drives for the length adjustment of the supporting rods. This is advantageous in particular in the case of heavy loads, likewise with regard to automation. The motor-driven actuating drives can be coupled both to hydraulically or pneumatically length-adjustable telescopic rods and to supporting rods in which the height adjustment is effected via a screw thread. In the latter case, for example, the supporting rods can be provided at each of their ends with a height-adjustment element, fixed or to be fixed on the respective bearing element, which is provided with a screw thread, wherein the two screw threads are however formed working in opposite directions, with the result that a rotation of the supporting rod between the two height-adjustment elements either extends or shortens the length on both sides, i.e., a rotation of the supporting rod in one direction either screws the screw threads out on both sides, thus brings about an extension on both sides, or screws it in on both sides, thus brings about a shortening on both sides. The use of two screw threads additionally relieves the load on the previously single screw thread and thus prevents material fatigue.

In a particularly preferred embodiment of the invention the device moreover comprises force sensors for measuring the bearing force of the second bearing element on one or more containers as well as an evaluation unit for reading and displaying and/or processing the values measured by the force sensors. For example, the evaluation unit can then be used to compare whether the loading still lies below a maximum permissible limit loading. If it lies above this in the case of one or more of the containers, then a length adjustment of the supporting rods in question can be carried out in a targeted manner in order to reduce the loading again. This can be effected automatically or manually. In the case of manual adjustment, aids can be provided which indicate to the person carrying out the adjustment whether the loading lies below the permissible limit loading or above it. This can be effected for example visually by means of signal lights.

However, it is also possible in particular to read the force sensors continuously, i.e., for example at particular equidistant points in time, in order thus to monitor the loading continuously over a predefined period of time. In this way, it is possible, for example, also to recognize material fatigue or settling, which can also lead to the collapse of the stack of bearing elements loaded with containers unless countermeasures are taken. In a particularly preferred embodiment of the invention the device therefore also comprises a controller for regulating the individual adjustment of the length of the supporting rods depending on the values measured by the force sensors and depending on predefined tolerances. For this, as already described, the loading is continuously monitored and read, for example, once or twice a day, wherein it can also be signalled via corresponding feedback when the loading changes too rapidly, i.e. for example there is a threat of material failure, with the result that immediate measures can then be instituted.

It is understood that the features named above and those yet to be explained in the following are applicable not only in the stated combinations but also in other combinations or alone, without departing from the scope of the present invention.

BRIEF DESCRIPTION OF THE SEVERAL VIEWS OF THE DRAWING(S)

Figure 2:
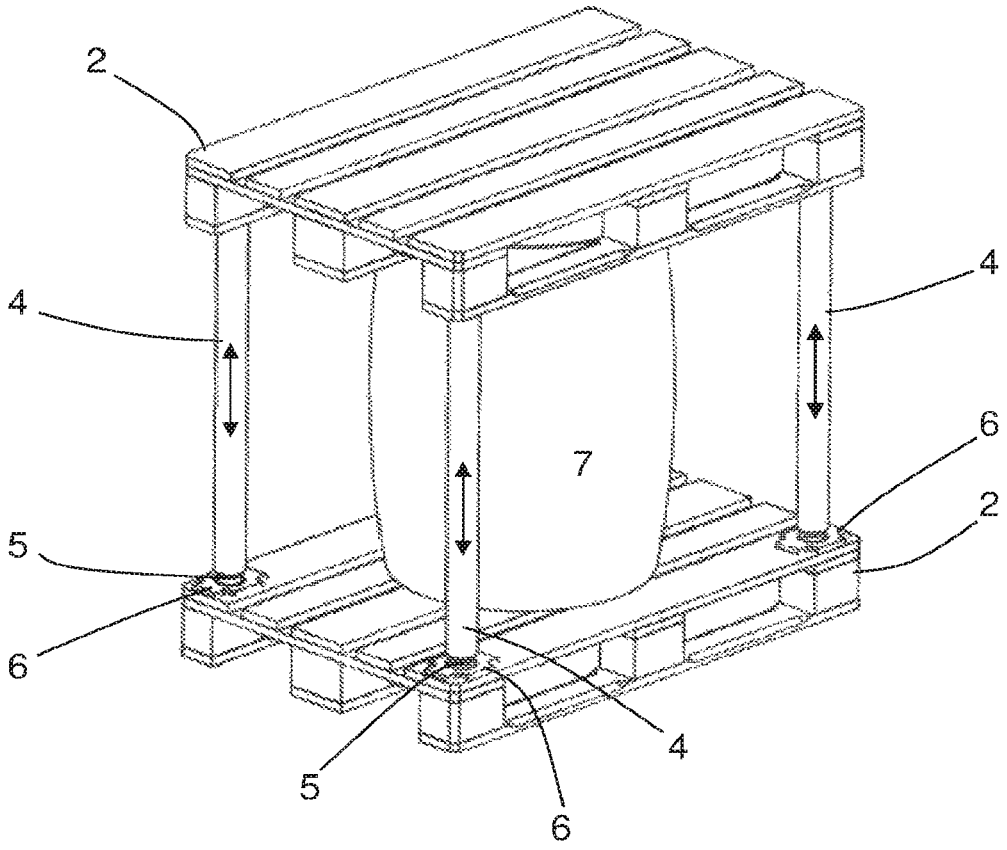
Figure 3A:
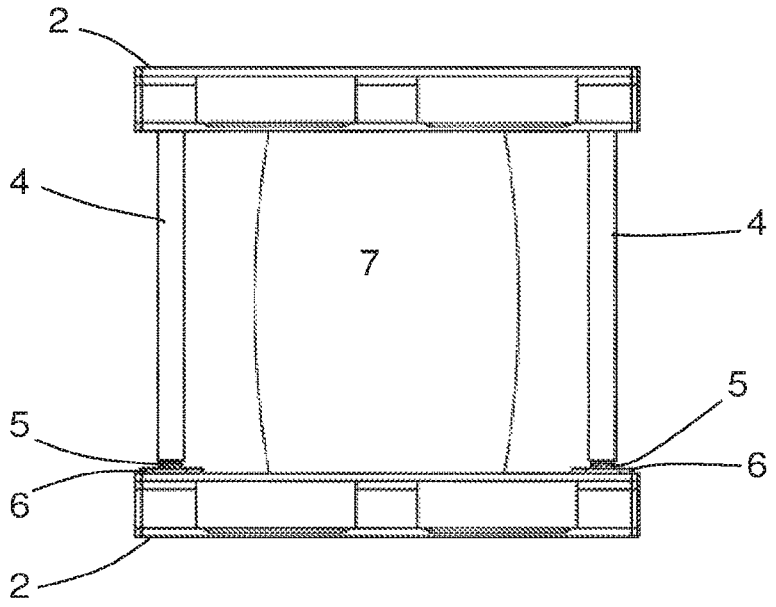
Figure 3B:
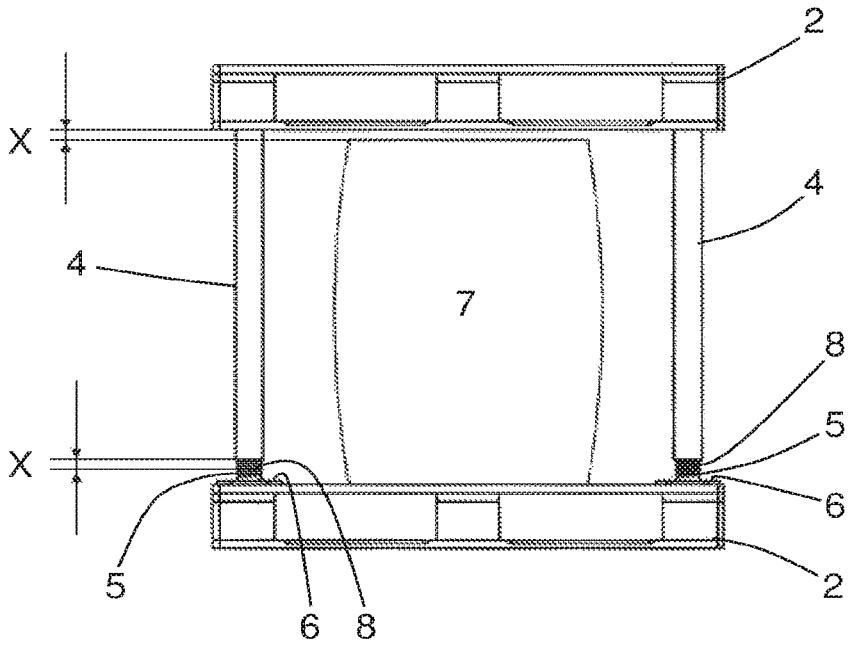
Figure 4:
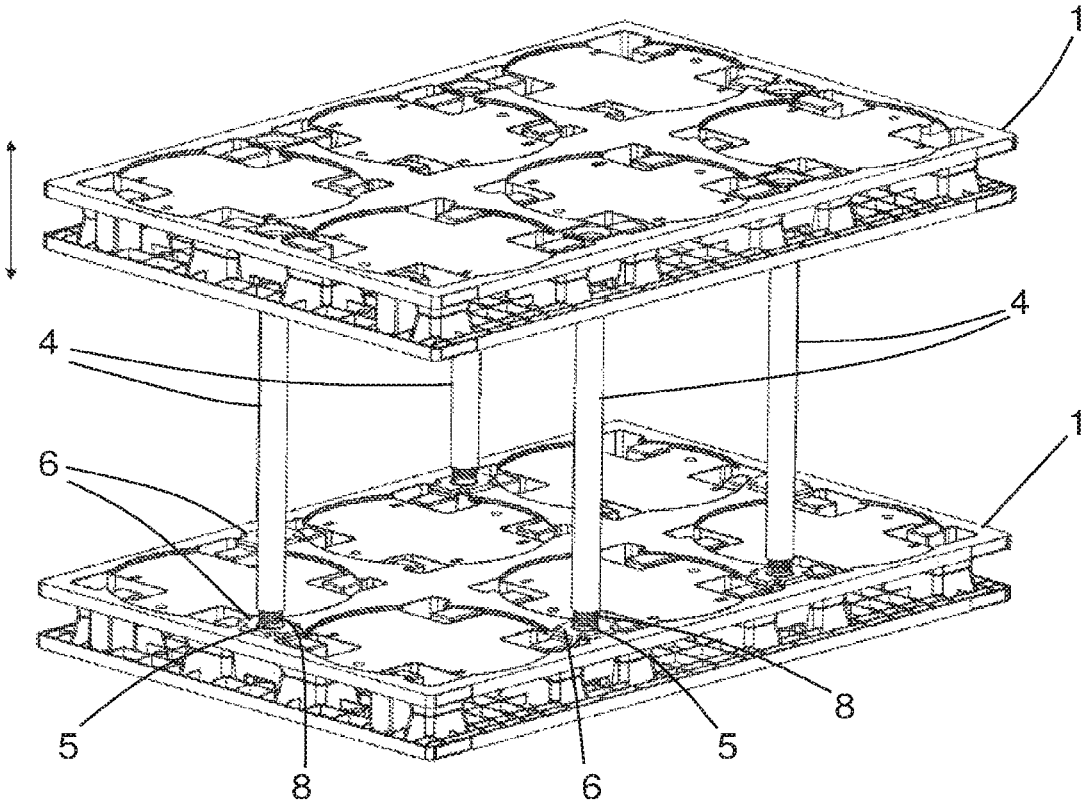
Figure 5A:
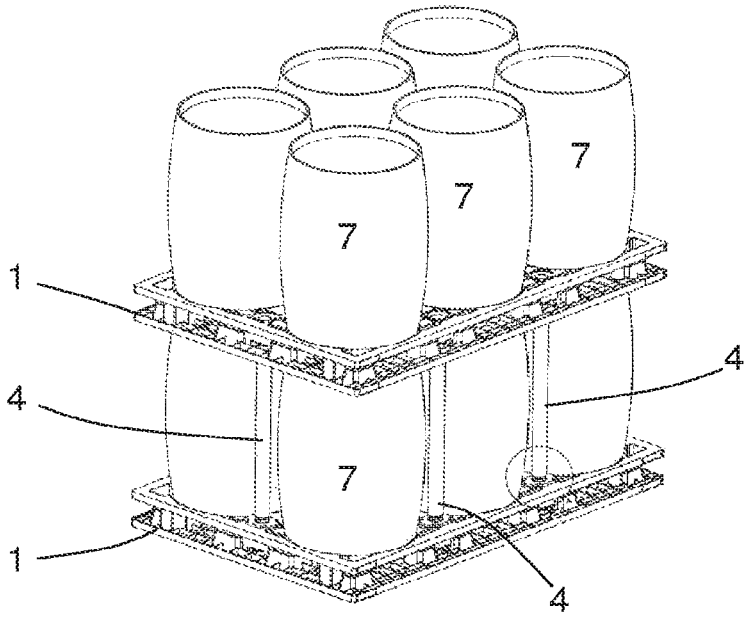
Figure 5B:
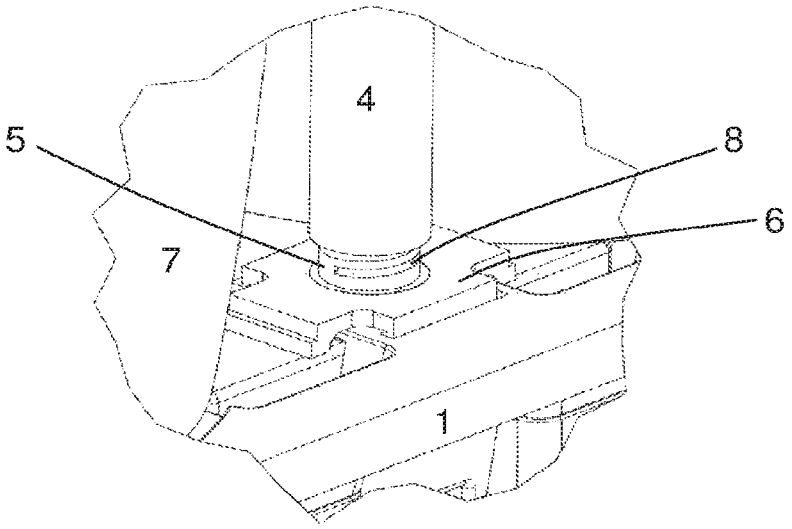
Figure 6A:
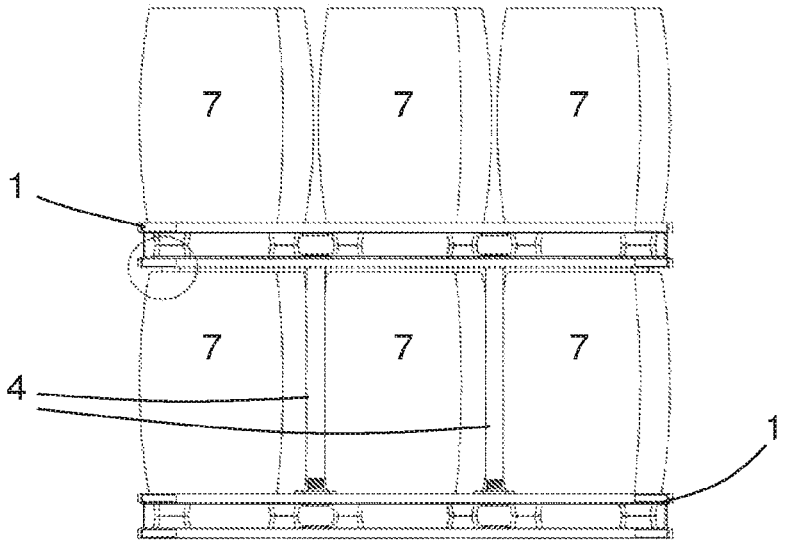
Figure 6B:
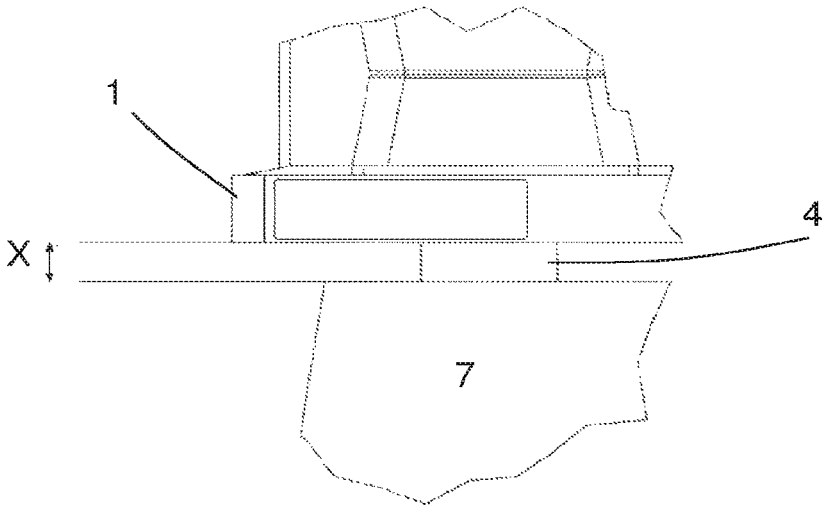
Figure 7A:
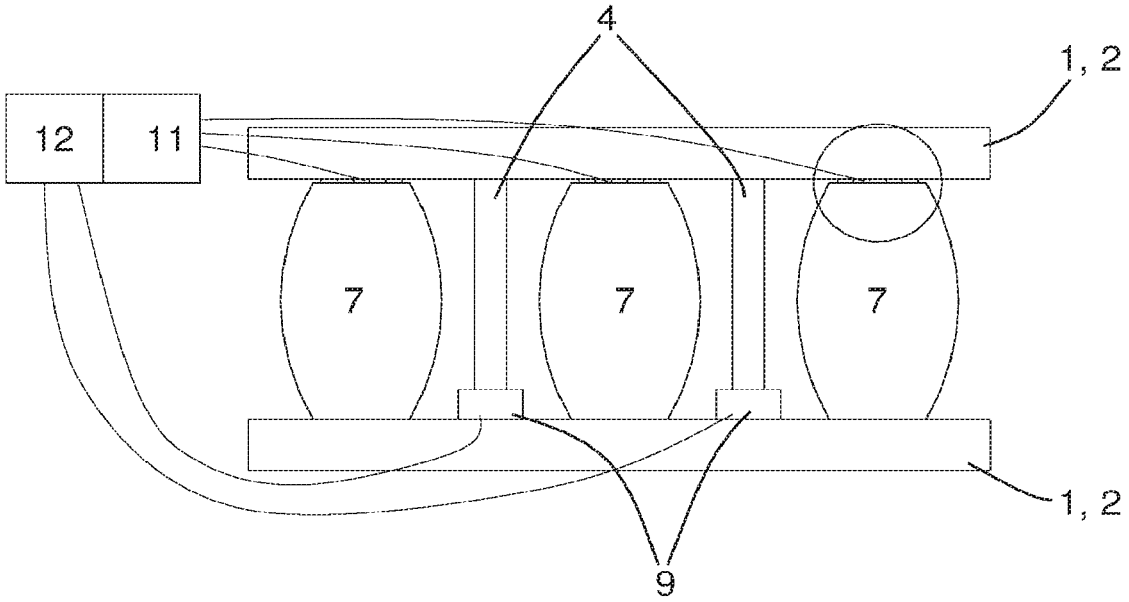
Figure 7B:
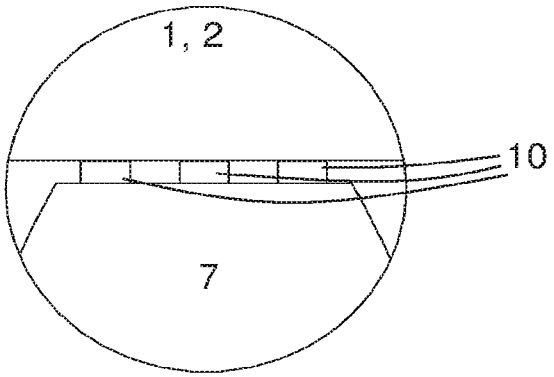

The invention is explained in even more detail below by way of example with reference to the attached drawings, which also disclose features essential to the invention. There are shown in:

FIG. 1 a first embodiment of the invention with three supporting rods,

FIG. 2 a second embodiment of the invention,

FIGS. 3*a*, 3*b* an illustration of the height adjustment,

FIG. 4 an embodiment of the invention with four supporting rods,

FIGS. 5*a*, 5*b* a further view of the device with a detail of the height adjustment, FIGS. 6*a*, 6*b* an embodiment in which force sensors are used, and FIGS. 7*a*, 7*b* an example of a device coupled to a control.

DETAILED DESCRIPTION OF THE DRAWINGS

FIG. 1 shows firstly the basic structure of a device for adapting the spacing between a first board-type bearing element, here a plastic pallet 1, which can also be designed as a composite pallet, i.e., with supporting inserts for example made of concrete, stone or wood to better distribute the loading, and a second board-type bearing element, here a wooden pallet 2, arranged above it. Both bearing elements are suitable and provided for storing containers, in particular bulk containers. Indentations 3 can be seen on the plastic pallet 1, these mark areas for depositing the containers, for example barrels. The device moreover comprises a number of supporting rods 4 for insertion between the first and second bearing elements, in the present case they are inserted between the plastic pallet 1 and the wooden pallet 2. In the example shown three supporting rods 4 are used, this is the minimum number of supporting rods 4 needed to enable a stable storage, unless the containers on the first bearing element are factored in for support. The device moreover comprises means for individually adjusting the length of the supporting rods 4 depending on the height of the containers for locally varying the spacing between the two bearing elements. These means are preferably provided for infinitely variable adaptation of the length, and the adjustability is symbolized by the double arrows on the supporting rods 4.

The means for adjusting the length of each supporting rod 4 can be designed differently. For example, the supporting rod 4 can be formed as a hydraulically or pneumatically length-adjustable telescopic rod; the supporting rod 4 can also be composed of two partial rods connected via a screw thread, which can then be rotated against each other in order to adjust the length. In the case represented the means for adjusting the length of each supporting rod 4 comprise, per supporting rod 4, at least one height-adjustment element 5, which is connected to one end of the supporting rod 4 via a screw thread. In the present case, height-adjustment elements 5 are connected to the supporting rods 4 in each case at the lower ends of the supporting rods 4. For example, the supporting rods 4 can have an internal screw thread and the height-adjustment elements 5 can have a matching external screw thread, with the result that the supporting rods are screwed onto the height-adjustment elements. A corresponding height-adjustment element 5 can also be attached to the upper ends of the supporting rods, which have two ends in each case.

The device in the example shown moreover comprises means for fixing the supporting rods 4 on the bearing elements. In the present case the means for fixing comprise fixing clamps 6, which are connected to the height-adjustment elements 5 and engage in or grip around corresponding recesses in the plastic pallet 1 or edges of such recesses. The fixing clamps 6 need not produce a friction-locking connection to the plastic pallet 1 or the first bearing element, a positive-locking connection which prevents a slipping in the lateral direction is sufficient. In particular in the case of wooden pallets 2, however, fixing means can also be used which connect to the wood in the manner of a nail or a cramp and which are thus driven into the wood.

The number of supporting rods 4 here is three, but depending on the size of the bearing element and the containers to be stored thereon more than three supporting rods 4 can also be used. Via the individual adjustment of the length of the supporting rods 4, the spacing of the second bearing element, here the wooden pallet 2, from the first bearing element can be adjusted locally and individually, symbolized here by the double arrows on the left and right of the wooden pallet 2.

If a height-adjustment element 5 is used only on one side of the supporting rod 4, then at the other end of the rod a mechanism is expediently provided which allows a rotation of the rod without adjusting the height when a second bearing element is lying on the supporting rods. It can be, for example, a rotating element, which is constructed outwardly similarly to the height-adjustment element 5, but does not have a screw thread, with the result that the supporting rod 4 is simply fitted on there and can rotate about its axis sufficiently frictionlessly.

At their upper ends and/or at their lower ends in each case the supporting rods 4 can be connected via a frame structure, not shown here, in a plane perpendicular to the normal direction of a large surface of the plastic pallet 1 or the wooden pallet 2, i.e., the two board-type bearing elements, which reduces the loading at isolated points of the bearing elements. The device can moreover comprise motor-driven actuating drives for the length adjustment of the supporting rod.

FIG. 2 shows a similar design of the device to that in FIG. 1, but here with two wooden pallets 2 as first and second bearing elements, wherein supporting rods 4 with height-adjustment elements 5 and fixing clamps 6 are arranged in each corner of the wooden pallets 2. The height adjustability is again indicated by double arrows, to symbolize a container a barrel 7 stands on the lower wooden pallet 2 as the first bearing element.

FIGS. 3*a* and 3*b* illustrate the height adjustment. Whereas in the situation shown in FIG. 3*a* the upper wooden pallet 2, i.e., the second bearing element, lies on the barrel 7, in the situation shown in FIG. 3*b* it has been raised upwards by an amount X, with the result that there is now an air gap X between the upper side of the barrel 7 and the under side of the upper wooden pallet 2, the adjustment here is effected via a screw thread 8.

FIG. 4 shows a similar situation to FIG. 1 and FIG. 2, but with two plastic pallets 1 and six supporting rods 4.

FIG. 5*a* shows a situation in which the first and second bearing elements in each case are formed as a plastic pallet 1. By way of example, six barrels 7 are stored vertically on each of the plastic pallets, in each case the length of six supporting rods 4 can be adjusted individually, with the result that the spacing between the two plastic pallets 1 can be varied locally. The section indicated with a circle in FIG. 5*a* is represented in detail in FIG. 5*b*. The screw thread 8 can be clearly seen on the height-adjustment element 5, likewise the fixing clamps 6.

The arrangement shown in FIG. 5*a* consisting of two bearing elements with barrels 7 arranged thereon is represented in a side view from the longer side in FIG. 6*a*. The section indicated with a circle in FIG. 6*a* is represented enlarged in FIG. 6*b*, the length of the supporting rods 4 here is adjusted such that the second bearing element, the upper plastic pallet 2, at no point lies on any of the barrels 7, but is borne exclusively by the supporting rods 4.

Finally, FIG. 7 shows a schematic diagram of a further development of a device such as has been described above, which comprises among other things motor-driven actuating drives 9 for the length adjustment of the supporting rods 4. FIG. 7*b* shows the section circled in FIG. 7*a* enlarged. Force sensors 10 which serve to measure the bearing force of the second bearing element on the container are here arranged between the under side of the second bearing element, for example a wooden pallet 2 or a plastic pallet 1, and the upper side of the container, for example the barrel 7. The force sensors can be designed loose, but can also be secured, for example adhesively, either to the upper side of the barrel 7 or to the under side of the second bearing element. The force sensors 10 are connected to an evaluation unit 11, which reads, displays and/or processes the values measured by the force sensors 10. The evaluation unit 11 for its part is connected to a controller 12, which triggers the individual adjustment of the length of the supporting rods 4 depending on the values measured by the force sensors 10 and on predefined tolerance values, for example a maximum and minimum loading. For this, the controller 12 is connected to the motor-driven actuating drives 9. In this way an almost completely automated monitoring of the stored barrels can be ensured, if necessary the regulation can independently alter the length of the supporting rods 4, both to longer and to shorter values. The supporting rods are then preferably hydraulically or pneumatically length-adjustable.

The device described above for adapting the spacing between two bearing elements which are constructed substantially board-type enables a storage while making the best possible use of the available space in terms of the height, wherein at the same time it is possible to cater for individual deviations in container heights and too strong a loading of containers stored on the bearing elements by bearing elements lying above them can be avoided.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

LIST OF REFERENCE NUMBERS

1 plastic pallet
2 wooden pallet
3 indentation
4 supporting rod
5 height-adjustment element

6 fixing clamp
7 barrel
8 screw thread
9 actuating drive
10 force sensor
11 evaluation unit
12 controller

What is claimed is:

1. A method for storing barrels vertically, comprising:

a. providing a system for storing barrels comprising a first board-type bearing element, a second board-type bearing element arranged over the first board-type bearing element and a plurality of supporting rods inserted between said first board-type bearing element and said second board-type bearing element;

b. storing at least one barrel in said system between said first and second board-type bearing elements;

wherein said method further comprises:

c. contacting an upper side of said at least one barrel with an under side of said second board-type bearing element allowing a part of the weight to be distributed between said at least one barrel and said plurality of supporting rods.

2. The method according to claim 1, further comprising distributing said weight so said part of said weight that is applied on said at least one barrel is below a predefined tolerance threshold of said barrel.

3. The method according to claim 1, further comprising connecting adapters for fixing the supporting rods on the first and second board-type bearing elements.

4. The method according to claim 3, wherein said adapters are selected from the group consisting of cramps, clamps, screws, and nails.

5. The method according to claim 1, wherein said plurality of supporting rods includes at least three supporting rods.

6. The method according to claim 1, wherein said first board-type bearing element and said second board-type bearing element are designed as a plastic, wooden, metal or composite pallet.

7. The method according to claim 1, further comprising providing and actuating a motor-driven actuating drive configured to adjust the lengths of the supporting rods.

8. The method according to claim 1, further comprising providing force sensors and an evaluation unit; and perform the following actions:

i. measuring by means of said force sensors a bearing force of said second bearing element on said at least one barrel; and ii. reading, displaying and/or processing, values measured by the force sensors by means of said evaluation unit.

9. The system according to claim 8, further providing a controller and perform the following actions:

i. regulating individual adjustment of each of the lengths of the supporting rods depending on the values measured by the force sensors and on predefined tolerance values.

10. The method according to claim 9, further comprising varying said lengths of said plurality of supporting rods so that said weight is distributed between said at least one barrel and said plurality of supporting rods within said predefined tolerance threshold.

11. The method according to claim 1, further comprising providing to said system for storing barrels:

a third board-type bearing element designed as a plastic, wooden, metal or composite pallet, the third board-type bearing element arranged over the second board-type bearing element;

a plurality of supporting rods inserted between the second board-type bearing element and the third board-type bearing element, and a plurality of spacing adjusters for individually and infinitely variably lengths of each of the plurality of supporting rods based on a height of the barrel for locally varying a spacing between the second and third board-type bearing elements.

12. The method of claim 1, further comprising providing a plurality of spacing adjusters for individually and infinitely variably lengths of each of the plurality of supporting rods based on a height of the barrel for locally varying a spacing between the first and second board-type bearing elements.

* * * * *